US008035310B2

(12) United States Patent
Chang et al.

(10) Patent No.: US 8,035,310 B2
(45) Date of Patent: Oct. 11, 2011

(54) CIRCUIT FOR DRIVING LIGHT SOURCE

(75) Inventors: Pi-Lun Chang, Taipei (TW); Hung-Hsiang Chen, Taipei County (TW); Yi-Nan Chu, Changhua Hsien (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 645 days.

(21) Appl. No.: 12/107,083

(22) Filed: Apr. 22, 2008

(65) Prior Publication Data

US 2009/0085489 A1 Apr. 2, 2009

(30) Foreign Application Priority Data

Sep. 28, 2007 (TW) ..... 96136244 A

(51) Int. Cl.
*H05B 37/00* (2006.01)

(52) U.S. Cl. ..... 315/291; 315/192; 315/193; 315/307; 315/308

(58) Field of Classification Search ..... 315/291, 315/307, 308, 224, 185 R, 186, 191, 192, 315/193
See application file for complete search history.

(56) References Cited

U.S. PATENT DOCUMENTS 6,351,079 B1 2/2002 Willis
2006/0082332 A1 * 4/2006 Ito et al. ..... 315/291
2010/0072922 A1 * 3/2010 Szczeszynski et al. ..... 315/297

FOREIGN PATENT DOCUMENTS

JP 2002343587 11/2002

* cited by examiner

*Primary Examiner* — David Hung Vu
(74) *Attorney, Agent, or Firm* — Jianq Chyun IP Office

(57) ABSTRACT

A light source driving circuit including a driving module, a plurality of first switches, a detecting unit, and a control unit is provided. The plurality of first switches is respectively coupled to corresponding light sources and these light sources are driven by the driving module. The detecting unit is coupled to the driving module to detect a working parameter of each light source and transmit the working parameter to the control unit. When the detecting unit detects some of these light sources are broken down, the control unit sequentially turns on the first switches to find out the failed light source. Moreover, the first switch coupled to the failed light source is remained on, and the driving signal is regulated according to the number of the failed light source, such that the brightness of the panel does not decrease.

8 Claims, 5 Drawing Sheets

CIRCUIT FOR DRIVING LIGHT SOURCE

CROSS-REFERENCE TO RELATED APPLICATION

This application claims the priority benefit of Taiwan application serial no. 96136244, filed on Sep. 28, 2007. The entirety the above-mentioned patent application is hereby incorporated by reference herein and made a part of specification.

BACKGROUND OF THE INVENTION

1. Field of the Invention

The present invention relates to a light source driving circuit and a controlling method thereof. More particularly, the present invention relates to a light source driving circuit to detect whether each light source works properly and short a failed one, and a controlling method thereof.

2. Description of Related Art

FIG. 1 shows a conventional backlight device. Referring to FIG. 1, the conventional backlight device includes a light-emitting module 105 and a resistor 107. When a power supply 103 provides a voltage for the light-emitting module 105 to operate, a working current $I_1$ is generated and flows through the light-emitting module 105 and the resistor 107.

FIG. 2 shows another conventional backlight device. Referring to FIG. 2, the backlight device includes two light-emitting modules 202*a*, 202*b*, switches 205*a*, 205*b*, and a current mirror 209. One end of the light-emitting modules 202*a*, 202*b* is coupled to the power supply 103, and the other end is coupled to the current mirror 209 through the switches 205*a*, 205*b* respectively. When the power supply 103 provides a voltage for the light-emitting modules 202*a*, 202*b* to operate, and the switches 205*a*, 205*b* are turned on, so as to generate corresponding working currents $I_2$, $I_3$.

In FIGS. 1 and 2, the light-emitting modules 105, 202*a*, 202*b* include a plurality of serially-connected LEDs. However, as the LEDs may be shorted or break due to the processes or other factors, when one or more LEDs in the light-emitting module break, the light-emitting module cannot be lighted, and the overall brightness greatly decreases. Besides, when one or more LEDs in the light-emitting module are shorted, the overall brightness also decreases.

SUMMARY OF THE INVENTION

Therefore, the present invention is directed to a light source driving circuit, for detecting a working parameter of each of the light sources, and determining whether the light sources work properly or not according to the working parameter.

From another point of view, the present invention is directed to a method for controlling the light source driving circuit, which shorts the failed light source, and regulates the brightness of the light sources according to the detected working parameter.

The present invention provides a light source driving circuit, which is adapted to drive a plurality of serially-connected light sources. The light source driving circuit includes a driving module, a plurality of first switches, a detecting unit, and a control unit. The plurality of first switches is respectively coupled to the corresponding light sources and these light sources are driven by the driving module. The detecting unit is coupled to the driving module to detect a working parameter of each light source and transmit the working parameter to the control unit. The control unit determines the ON/OFF state of the first switches according to the working parameter.

From another point of view, the present invention provides a method for controlling the light source driving circuit, which includes the following steps. A plurality of light sources is driven and a working parameter of the light sources is measured. When the working parameter cannot be measured, the light sources are sequentially shorted to find out the failed light source. Moreover, the failed light source is remained shorted, and the brightness of the light sources is regulated according to the latest working parameter.

As the light source driving circuit provided by the present invention detects a working parameter of each of the light sources, and determines whether the light sources work properly or not according to the working parameter. When a part of the light sources fails, the present invention sequentially shorts the light sources to find out the failed one, and remains shorting the failed light source. Moreover, the brightness of the light sources is regulated according to the latest detected working parameter.

In order to make the aforementioned and other objects, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
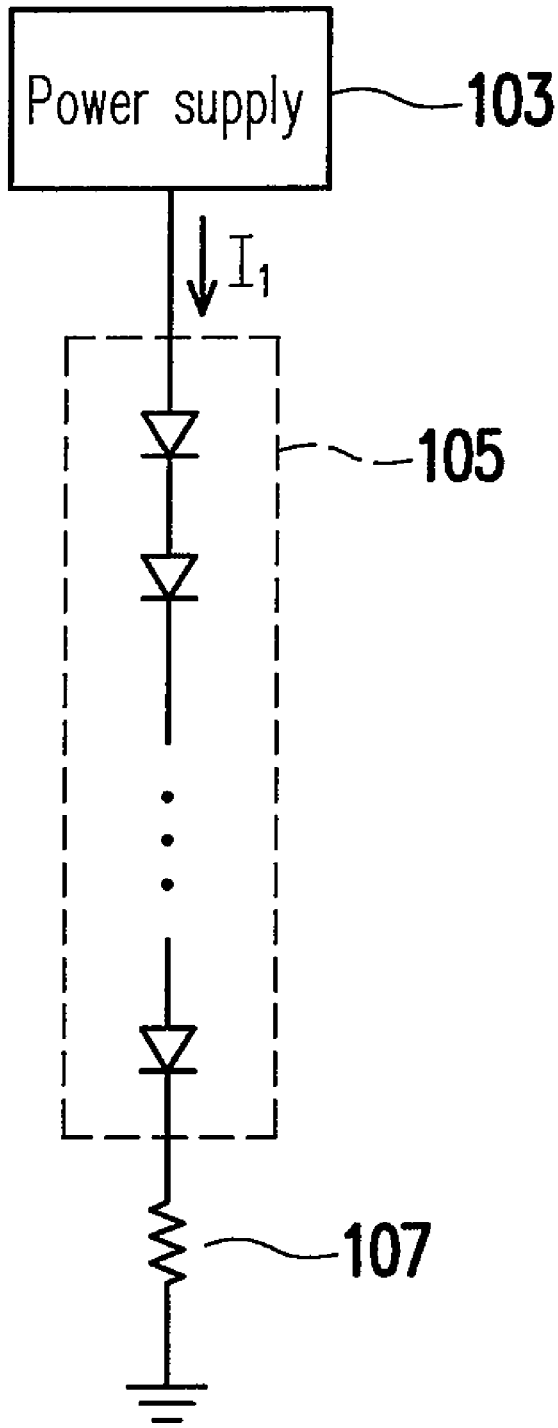
FIG. 1 (PRIOR ART)
FIG. 1 shows a conventional backlight device.
Figure 2:
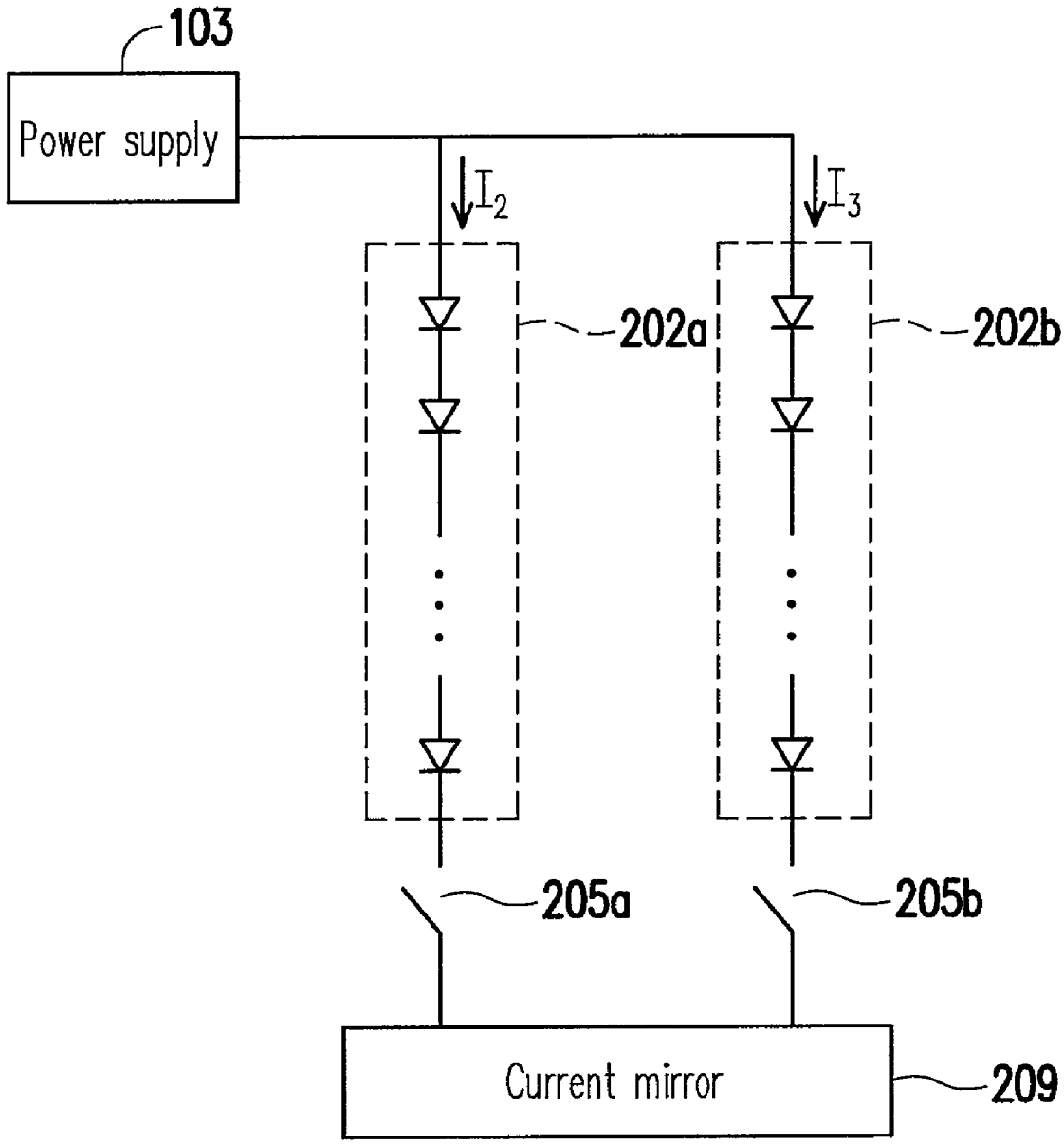
FIG. 2 (PRIOR ART)
FIG. 2 shows another conventional backlight device.
Figure 3:
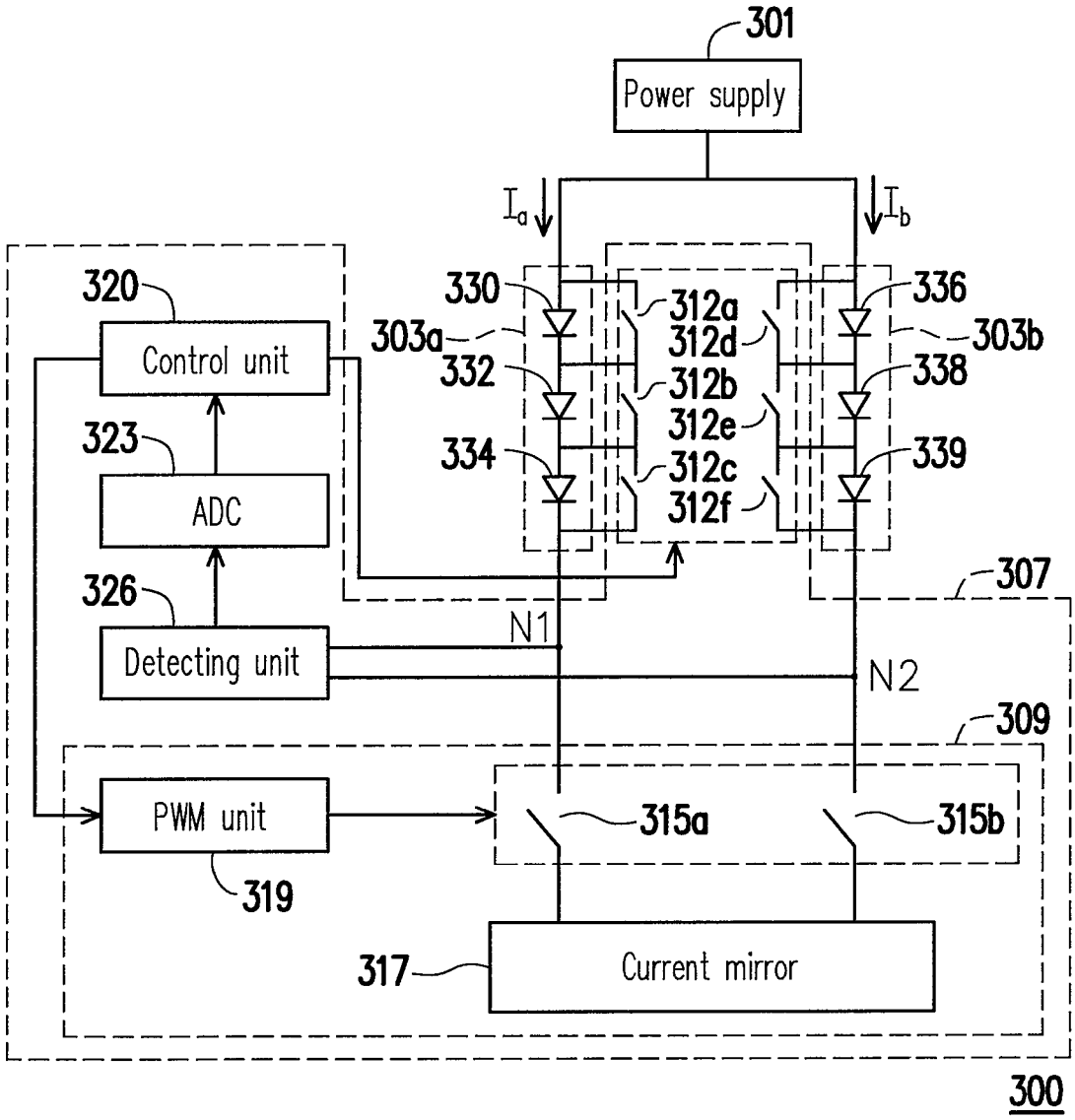
FIG. 3 is a circuit diagram of a light-emitting device according to an embodiment of the present invention.

FIG. 3 is a circuit diagram of a light-emitting device according to an embodiment of the present invention. Referring to FIG. 3, the light-emitting device 300 includes light-emitting modules 303*a*, 303*b* and a light source driving circuit 307. The light-emitting modules 303*a*, 303*b* include a plurality of serially-connected light sources, for example, LEDs 330-339. The cathode end of an LED is coupled to the anode end of the next LED, the anode end of the first LEDs 330, 336 receives a voltage source, and the cathode end of the last LEDs 334, 339 is coupled to the light source driving circuit 307. In particular, the light source driving circuit 307 provided by the present invention also detects whether the light-emitting modules 303*a*, 303*b* work properly.

Referring to FIG. 3, the light source driving circuit 307 includes a plurality of switches 312*a*-312*f*, a driving module 309, a control unit 320, and a detecting unit 326. The driving module 309 is used to drive each light source of the light-emitting modules 303*a*, 303*b*. The detecting unit 326 is coupled to the driving module 309, so as to detect the working parameter of the light-emitting modules 303*a*, 303*b*, and transmit the detection result to the control unit 320.

In the present invention, a part of the switches 312*a*-312*f* is coupled to the light-emitting module 303*a*, and the other part is coupled to the light-emitting module 303*b*. For example, both ends of the switch 312*a* are respectively coupled to the anode end and the cathode end of the LED 330. Whereby, the driving circuit 307 determines whether the light sources of the light-emitting modules 303*a*, 303*b* work properly according to the ON/OFF state of the switches 312*a*-312*f*, and the details will be illustrated in the following paragraphs.

In this embodiment, the driving module 309 includes switches 315*a*, 315*b*, a current mirror 317, and a pulse width modulation (PWM) unit 319. The current mirror 317 is coupled to the light-emitting modules 303*a*, 303*b*, and generates a current signal to the corresponding light-emitting modules 303*a*, 303*b* respectively. The switches 315*a*, 315*b* are disposed between the light-emitting modules 303*a*, 303*b* and the current mirror 317. The ON/OFF state of the switches 315*a*, 315*b* are determined by a control signal generated by the PWM unit 319, so as to determine whether or not to transmit the current signal to the light-emitting modules 303*a*, 303*b*.

Furthermore, in this embodiment, the light source driving circuit 307 further includes an analog-to-digital converter (ADC) 323 disposed between the control unit 320 and the detecting unit 326. The ADC 323 is mainly used to convert an analog detection signal generated by the detecting unit 326 into a digital detection signal, and transmit the digital detection signal to the control unit 320.

Referring to FIG. 3, when the power supply 301 provides power for the light-emitting modules 303*a*, 303*b* to operate, and the switches 315*a*, 315*b* are turned on, corresponding working currents Ia, Ib are generated and respectively flow through each of the LEDs 330-339, the switches 315*a*, 315*b*, and the current mirror 317 of the light-emitting modules 303*a*, 303*b*. Moreover, the detecting unit 326 respectively detects the working parameter at nodes N1, N2, and transmits the detection result to the ADC 323. Whereby, the ADC 323 converts an analog detection signal into a digital detection signal, and transmits the digital detection signal to the control unit 320. In this embodiment, the working parameter is a current signal or a voltage signal.

If at least one of the LEDs 330-334 of the light-emitting module 303*a* breaks, the detecting unit 326 is unable to detect any working parameter. On receiving the detection result, the control unit 320 generates a control signal to control the ON/OFF state of the switches 312*a*-312*c*, so as to find out the failed LED, and turn on the switch corresponding to the failed LED, thereby making the light-emitting module 303*a* remain operating.

In Table 1, when one LED of the light-emitting module 303*a* fails to work properly, the control unit 320 sequentially turns on the switches 312*a*-312*c* to detect the failed LED. In Table 1, "0" denotes the corresponding switch is turned off, and "1" denotes the corresponding switch is turned on.

TABLE 1

| | | | |
|---|---|---|---|
| 312a | 1 | 0 | 0 |
| 312b | 0 | 1 | 0 |
| 312c | 0 | 0 | 1 |

In Table 1, the switch 312*a* is turned on, and the switches 312*b*, 312*c* are turned off. At this time, if the detecting unit 326 detects the working parameter of the light-emitting module 303*a*, the LED 330 breaks. That is to say, the LED 330 fails. On the contrary, if the detecting unit 326 cannot detect the working parameter of the light-emitting module 303*a*, the LED 330 works properly. It can be deduced in the above manner that, the present invention finds out the failed LED by turning ON/OFF each of the switches.

Provided that when the detecting unit 326 still cannot detect the working parameter of the light-emitting module 303*a* after all the switches are turned on sequentially, more than one LED might fail. Thus, the present invention proceeds to the detection mode listed in Table 2. That is to say, two switches are turned on sequentially at the same time to find out the failed LED. In Table 2, permutations and combinations of two switches which are turned on at the same time are listed. It can be deduced in the above manner that, if the working parameter cannot be detected in the mode in Table 2, three, four, . . . , N switches are turned on at the same time till a working parameter is detected, in which N is a positive integer.

TABLE 2

| | | | |
|---|---|---|---|
| 312a | 1 | 0 | 1 |
| 312b | 1 | 1 | 0 |
| 312c | 0 | 1 | 1 |

In the present invention, when a failed LED is detected, the switch corresponding to the failed LED is remained shorted. For example, when it is detected that the LED 330 fails, the switch 312*a* is remained turning on. Whereby, the overall light-emitting device operates properly.

Referring to FIG. 3, in this embodiment, when the switch corresponding to the failed LED is turned on, the voltage at the node (for example, N1 or N2) where the light-emitting module and the driving module 309 are coupled is raised. For example, when it is determined that the LED 330 fails and the switch 312*a* is turned on, the voltage at the node N1 where the light-emitting module 303*a* and the driving module 309 are coupled is raised. The same situation may also occur when any LED of the light-emitting module 303*a* is shorted due to the processes or other factors. The voltage V at the node (for example, N1 or N2) where the light-emitting module and the driving module 309 are coupled may be expressed by the following mathematical expression:

$$V=Vrp+nV_F \tag{1}$$

Voltage Vrp is the voltage at the nodes N1, N2 when all the LEDs of the light-emitting modules 303*a*, 303*b* operate properly. VF is a forward voltage of the LEDs. n is the number of the shorted LED. Seen from the expression (1), the node voltage V is related to the number of the shorted LED.

When the corresponding switch is turned on as any LED of the light-emitting module is shorted or breaks, the brightness of the light-emitting module 303*a* and/or 303*b* decreases. Therefore, the control unit 320 generates a control signal to the PWM unit 319 based on the expression (1), so as to control a PWM signal output by the PWM unit 319, thus determining the time to turn on the switches 315*a*, 315*b*. Whereby, the brightness of the light-emitting modules 303*a*, 303*b* is substantially the same.

Though the configuration of the light-emitting module is disclosed in the above embodiments, those skilled in the art would appreciate that the above description and drawings are used for illustration only instead of limiting the scope of the present invention. In the present invention, the number of the light sources of the light-emitting modules 303*a*, 303*b* is not limited to three, and may be increase according to requirements.

Figure 4:
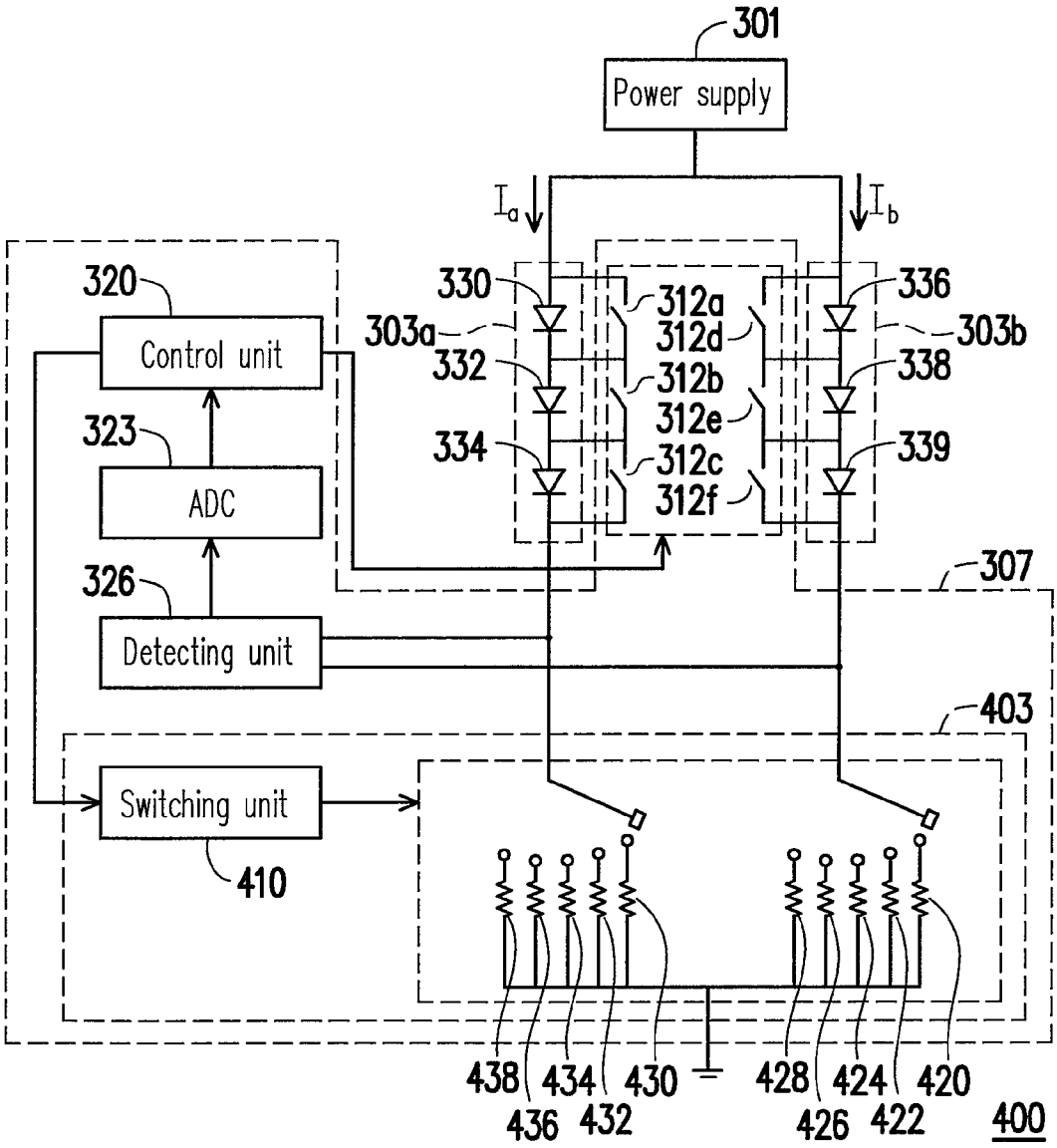
FIG. 4 is a circuit diagram of a light-emitting device according to another embodiment of the present invention.

FIG. 4 is a circuit diagram of a light-emitting device according to another embodiment of the present invention. Referring to FIG. 4, functional blocks having the same numbers or names of the light-emitting devices in FIG. 3 have identical functions and working principles. The difference between the light-emitting device 400 of this embodiment and that of the first embodiment is that, the driving module 403 includes a switching unit 410 and a plurality of resistors 420-438. Each of the resistors 420-438 has a different resistance value. The switching unit 410 is used to receive a control signal generated by the control unit 320, and the light-emitting modules 303*a*, 303*b* are optionally coupled to one of the resistors 420-438 according to the control signal.

Referring to FIG. 4, the driving module 403 of the light-emitting device 400 is first coupled to a preset resistor. When the power supply 301 provides a fixed voltage source to the light-emitting modules 303*a*, 303*b*, corresponding working currents Ia, Ib are generated and flow through the light-emitting modules 303*a*, 303*b* and the corresponding preset resistor. At this time, the detecting unit 326 detects a working parameter, and generates a detection signal to the ADC 323. The ADC 323 converts the detection signal into a digital signal and transmits the digital signal to the control unit 320. The control unit 320 then generates a control signal to the switching unit 410 according to the detection signal, such that the switching unit 410 selects an appropriate resistor from the resistors 420-438 to make the brightness of the light-emitting modules 303*a*, 303*b* to be substantially the same.

Moreover, as the magnitude of the working currents Ia, Ib is related to the coupled resistors 420-438, the switching unit 410 selects the resistance values to which the light-emitting module is coupled, so as to control the magnitude of the working currents I*a*, I*b*, such that the brightness of the panel meets the requirement of the users.

In addition, when a light source of the light-emitting modules 303*a*, 303*b* is shorted or breaks, the failed LED may be found out according to the description of FIG. 3, and the corresponding switch is shorted. Afterwards, the control unit 320 generates a control signal, and the switching unit 410 switches the light-emitting module to be coupled to the appropriate resistor, so as to regulate the brightness of the light-emitting module. Moreover, in this embodiment, the control unit 320 determines whether there is a failed LED of each of the light-emitting modules 303*a*, 303*b* by determining the resistance value of the resistors coupled to the light-emitting modules 303*a*, 303*b*.

Figure 5:
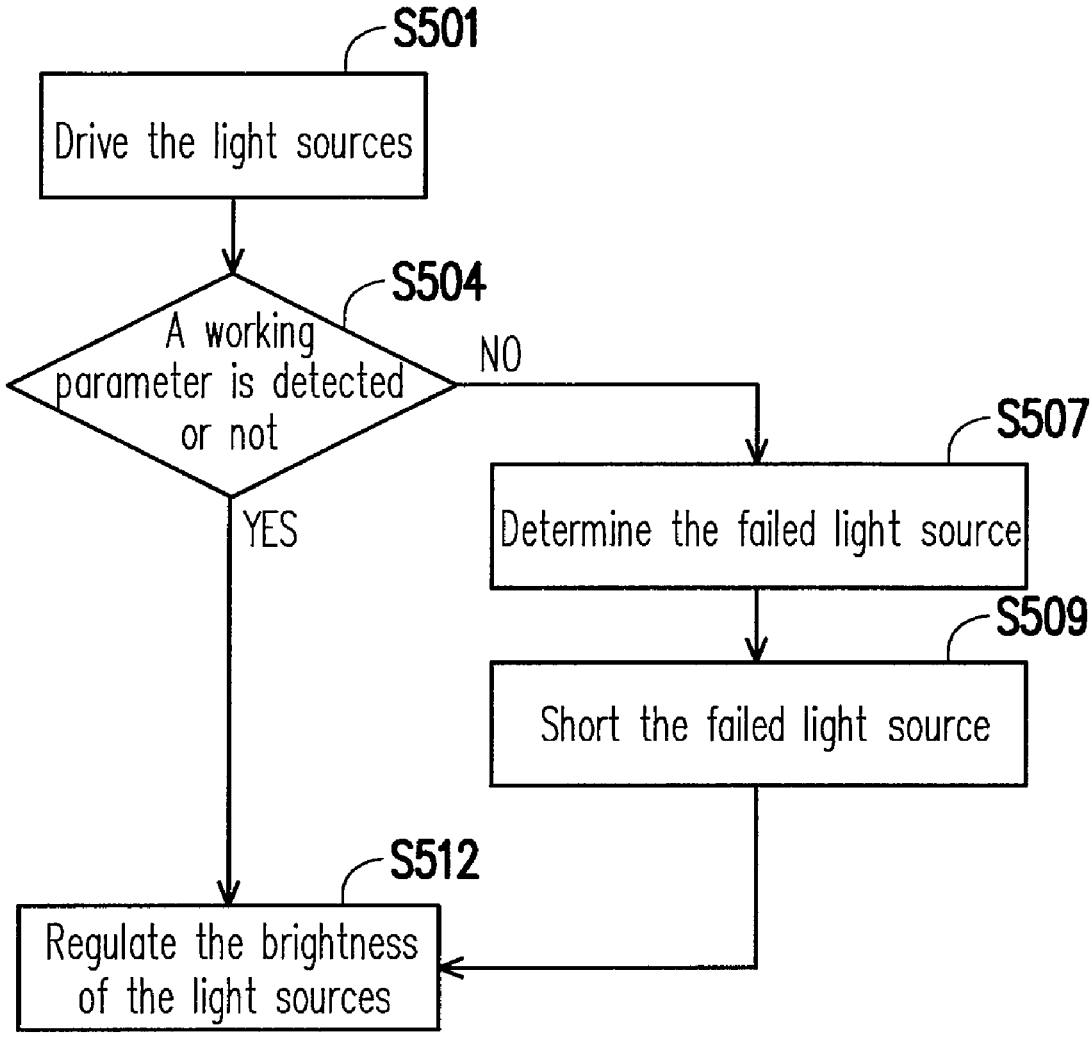
FIG. 5 is a flow chart of the processes of a method for controlling the light-emitting device according to an embodiment of the present invention.

FIG. 5 is a flow chart of the processes of a method for controlling the light-emitting device according to an embodiment of the present invention. Referring to FIG. 5, in this embodiment, the method for controlling the light source driving circuit includes driving each light source of the light-emitting device (S501).

The light-emitting device applied in the present invention, for example as shown in FIG. 3 or FIG. 4, includes a plurality of serially-connected light sources. When the light sources are driven, a working parameter is measured. If the working parameter of the light sources is measured, at least one light source in the light-emitting device fails, and the light-emitting device thus cannot operate properly.

The method for controlling the light source driving circuit of this embodiment can detect the failed light source. The failed light source may be determined by sequentially shorting each light source (S507). When one of the light sources is shorted, a working parameter is determined to be detected or not. If a corresponding working parameter is detected, the light source is remained shorted (S509), so that the light-emitting device operates properly. On the contrary, if a working parameter cannot be detected, the next light source is shorted in sequence, and Steps S504-S509 are repeated.

If a working parameter of the light sources still cannot be detected after each light source is shorted sequentially, at least two light sources fail. Next, the situations that only two light sources are shorted are listed, and the failed light source may be found out according to these situations.

At this time, if the working parameter still cannot be detected, at least three or above light sources fail at the same time. Thus, three, four, . . . , N switches are turned on sequentially at the same time till a working parameter is detected, in which N is a positive integer. In this embodiment, all the failed light sources are found out and remained shorted, so as to make the light-emitting device operate properly.

After all the failed light sources are shorted, the brightness of the light-emitting device decreases. Besides, the brightness of the light-emitting device may also decrease as any light source is shorted due to the processes or other factors. Thus, the light source driving circuit can regulate the brightness of the light sources according to the latest detected working parameter (S512). In this embodiment, the working parameter is a working voltage of the light sources. When the working voltage of the light sources exceeds a normal value, the brightness of the light sources decreases.

In view of the above, this embodiment provides a light source driving circuit to find out the failed light source by sequentially shorting each light source, and remain shorting the failed one, thereby making the light-emitting device remain operating. Moreover, the light source driving circuit of this embodiment can regulate the brightness of the light sources according to a working parameter thereof, such that the brightness of the panel may not decrease when a part of the light sources is shorted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A circuit for driving light source, adapted for driving a plurality of serially-connected light sources, comprising:

a driving module, for driving the light sources;

a plurality of first switches, each of the first switches coupled to both ends of one of the corresponding light sources;

a detecting unit, coupled to the driving module, for detecting a working parameter of the light sources, so as to provide a detection result; and a control unit, coupled to the detecting unit, for controlling operations of the plurality of first switches according to the detection result, wherein when at least one of the light sources is failed, the detection unit provides the detection result without having the working parameter to the control unit, and then the control unit controls ON/OFF state of the each of the first switches to find out the failed light source, then turn on a first switch of the plurality of first switches corresponding to the failed light source and turn off remaining first switches of the plurality of first switches corresponding to the normal light sources to thereby maintain the lighting-up of the serially-connected light sources.

2. The circuit as claimed in claim 1, wherein the light sources are a plurality of light-emitting diodes (LEDs).

3. The circuit as claimed in claim 2, wherein a cathode end of each of the LEDs is coupled to an anode end of the next LED, an anode end of the $1^{st}$ LED is coupled to a voltage source, and a cathode end of the last LED is coupled to the driving module.

4. The circuit as claimed in claim 1, wherein the driving module comprises:

a current mirror, coupled to the light sources, for generating a plurality of current signals to the light sources;

a second switch, for determining whether or not to conduct the current signals to the light sources according to a control signal; and a pulse width modulation (PWM) unit, for generating the control signal to the second switch according to the control unit.

5. The circuit as claimed in claim 1, wherein the driving module comprises:

a plurality of resistors, having different resistance values; and a switching unit, for selectively coupling the light sources to one of the resistors.

6. The circuit as claimed in claim 1, further comprising an analog-to-digital converter (ADC), for converting the output of the detecting unit into a digital signal to the control unit.

7. The circuit as claimed in claim 1, wherein the detecting unit is used for detecting a working voltage of the light sources.

8. The circuit as claimed in claim 1, wherein the detecting unit is used for detecting a working current of the light sources.

* * * * *